United States Patent [19]

Nichols

[11] 4,002,237

[45] Jan. 11, 1977

[54] PENCIL CADDY

[75] Inventor: Gordon E. Nichols, Middleboro, Mass.

[73] Assignee: Winthrop-Atkins Co., Inc., Middleboro, Mass.

[22] Filed: May 5, 1975

[21] Appl. No.: 574,746

[52] U.S. Cl. ..... 206/371; 229/41 C; 248/459

[51] Int. Cl.[2] ..... B65D 85/28; A45C 11/34

[58] Field of Search ..... 206/371, 372, 373; 229/41 C; 248/459

[56] References Cited

UNITED STATES PATENTS

| | | | |
|---|---|---|---|
| 1,117,824 | 11/1914 | Fleming | 206/371 |
| 2,852,206 | 9/1958 | Bolding | 229/41 C |
| 3,101,167 | 8/1963 | Styler | 229/41 C |
| 3,280,492 | 10/1966 | Nichols | 248/459 |
| 3,305,205 | 2/1967 | Frankl | 248/459 |

*Primary Examiner*—William T. Dixson, Jr.
*Attorney, Agent, or Firm*—Dike, Bronstein, Roberts, Cushman & Pfund

[57] ABSTRACT

A pencil caddy comprising an elongated hollow body hinged at its opposite longitudinal sides so as to be flattenable and having re-entrant open ends and flexible end members hinged at their opposite ends to the open ends of the body yieldably biased into said recessed open ends to hold the body distended, said end members being adapted to be withdrawn from said open ends to permit the body to be flattened and one or more openings in the upper side of the body for receiving and supporting in upright positions pencils, pens and the like.

6 Claims, 9 Drawing Figures

PENCIL CADDY

BACKGROUND OF THE INVENTION

Pencil caddies in various forms are disclosed in U.S. Pat. Nos. 1,831,712; 3,198,339; 3,203,552; 3,207,320; 3,280,492 and 3,281,975. Most of the structures shown in these patents are comprised of a relatively stiff cardboard or thin metal which may be cheaply and inexpensively manufactured and in most cases are designed to receive a calendar pad and/or advertising material. The pencil caddy of this invention is of generally similar kind in that it is comprised of sheet material but is of simpler design so as to be more easily manufactured on conventional paperboard die cutting machinery, is easier to set up and collapse than such prior structures and provides for a somewhat more attractive, less stylized structure than the conventional easel.

SUMMARY OF INVENTION

As herein illustrated the pencil caddy comprises an elongated hollow body hinged along its opposite longitudinal sides so as to be flattenable, having re-entrant open ends within which are biased flexible end members hinged at their opposite ends to the open which hold the body distended. The end members have at one end laterally extending parts symmetrical with respect to the longitudinal axis of the body and in planes at right angles thereto which provide supporting feet for supporting the body in stable equilibrium in a horizontal position so that one side of the body faces upwardly and there are one or more openings along the upwardly facing side for supporting pencils, pens and the like therein. More specifically, the body is substantially rectangular in cross section having spaced parallel top and bottom walls and spaced side walls, the latter being hingedly connected at their upper and lower edges to the top and bottom walls. The side walls are divided longitudinally midway between their top and bottom edges and hingedly connected so as to permit folding of the side walls and hence flattening of the structure in a plane containing the side wall hinges such that the top wall and upper portions of the side walls lie in a common plane and the bottom wall and the lower portions of the side walls lie in a common plane. The distal edges of the top and bottom portions of the side walls are longer than the proximal edges so that the end edges of the sections slant from the longer edges to the shorter edges providing in the erected structure the re-entrant open ends. The end members are hinged midway between their opposite ends to each other and are hinged at the distal ends to the end edges of the top and bottom walls so as to be foldable in either direction and when the body part is folded the end members fold on themselves into the plane of the top and bottom walls.

Figure 1:
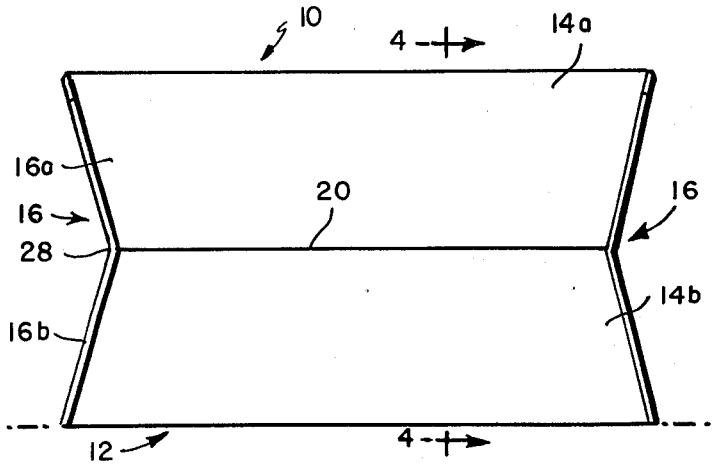
FIG. 1 is an elevation of one side of the pencil caddy of this invention.

Referring to the drawings, the caddy comprises an elongated hollow body having top, bottom and side walls 10, 12 and 14—14 and end walls 16—16. The side walls 14—14 are connected by longitudinally extending hinges 18—18 at their upper and lower edges to the longitudinally extending edges of the top and bottom walls 10 and 12. The top and bottom walls 10 and 12 are rectangular, having spaced parallel longitudinal edges and spaced parallel end edges. The side walls 14—14 are divided longitudinally midway between their upper and lower edges into upper and lower trapezoidal panels **14*a*—14*a* and 14*b*—14*b*. The outer edges are connected to the top and bottom walls by the hinges 18 and the inner edges which are shorter than the outer edges are connected to each other by hinges 20—20. The ends of the side walls 14—14 are thus symmetrically re-entrant with respect to the longitudinal hinges 20—20.**

The end walls 16—16 are trapezoidal in shape having upper and lower spaced parallel edges 22 and 24 connected by hinges 26 to the end edges of the top and bottom walls 10 and 12. The side edges 27—27 of the end walls diverge from their upper ends to their lower ends. Each end wall is divided midway between its upper and lower edges into upper and lower panels **16*a*, 16*b* by a transversely extending hinge 28.** The length of each end wall from top to bottom corresponds to the lengths of the re-entrant end edges of the side walls.

Figure 8:
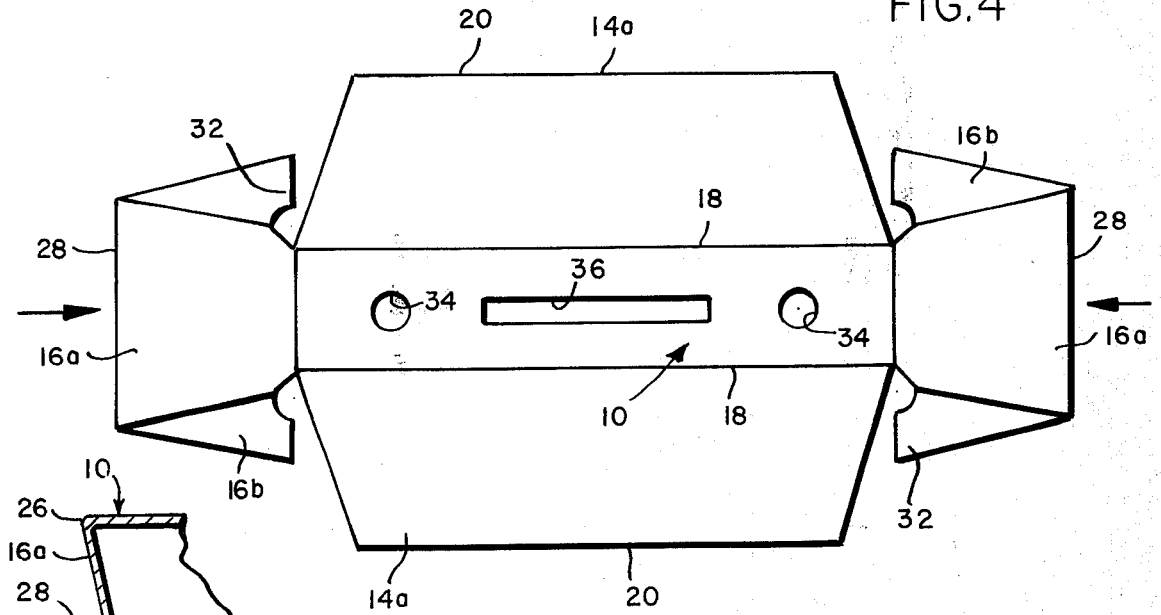
FIG. 8 is a plan view of the pencil caddy completely flattened.
Figure 5:
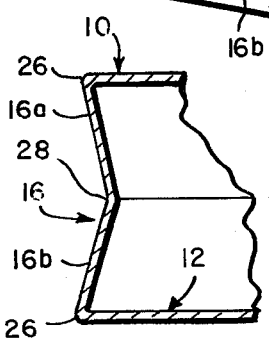
FIG. 5 is a fragmentary vertical section taken on the line 5—5 of FIG. 2.
Figure 6:
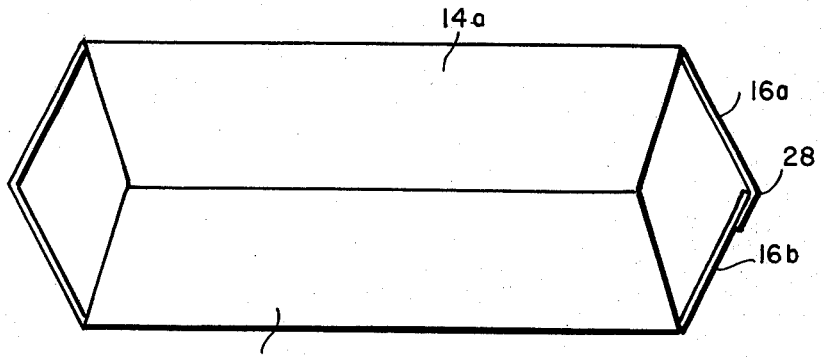
FIG. 6 is an elevational at one side of the pencil caddy showing it partially folded.
Figure 7:
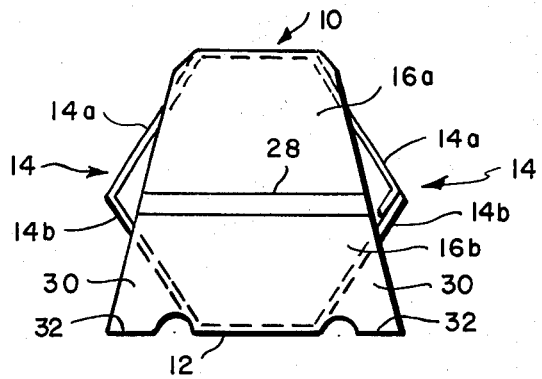
FIG. 7 is an end elevation of FIG. 6.

As thus constructed, the top, bottom and side walls are adapted to be held extended by flexing the end walls into the re-entrant end openings against the re-entrant end edges of the side walls. When the end walls are withdrawn from the re-entrant open ends the body may be collapsed by folding of the side walls on the hinges 20—20 and the end walls on the hinges 28—28. In the flattened condition the top wall and the two upper panels of the side walls lie in a common plane in face-to-face contact with the bottom wall, and the two lower panels of the side walls and the upper and lower panels of the end walls fold upon themselves and lie in a common plane with that of the top and bottom walls as shown in FIG. 8. FIGS. 6 and 7 show the side and end walls at an intermediate stage of folding.

Each of the end walls is transversely wider than the open end of the body section so that it covers the entire open end to which it is connected and has at its edges transversely extending flanges 30—30, the lower edges of which provide transversely spaced feet 32—32 for supporting the structure in stable equilibrium.

Figure 9:
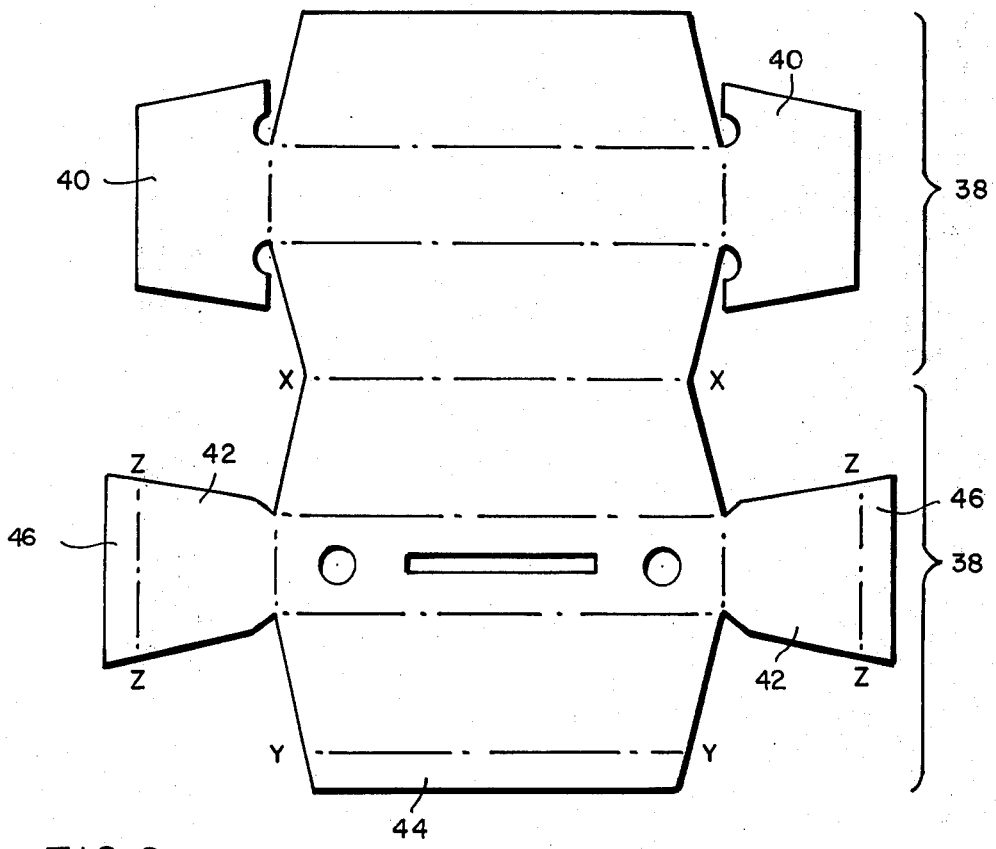
FIG. 9 is a plan view of the blank prior to folding and gluing to form the flattened blank shown in FIG. 8.

The blank for the structure as shown in FIG. 9 is comprised of a suitable flexible relatively stiff paperboard or its equivalent, die cut and scored to provide two sections 38—38 of the same shape, one of which constitutes the top wall and the upper side wall panels and the other the bottom wall and the lower side wall panels foldable on the line X—X and sections 40—40 and 42—42 at the ends of the sections 38—38 which constitute the upper and lower end wall panels. One of the sections 38 has along its distal edge a tab 44 foldable along the line Y—Y and each of the sections 42 has at its end a tab 46 foldable along a line Z—Z. The tabs 44 and 46 provide for connecting the distal ends of the sections 38—38 to each other to form the body of the structure and the tabs 46 provide for connecting the upper and lower end wall panels to provide the ends of the structure.

Figure 3:
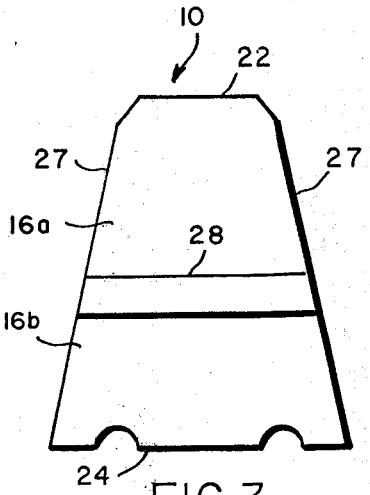
FIG. 3 is an end view of FIG. 1.
Figure 2:
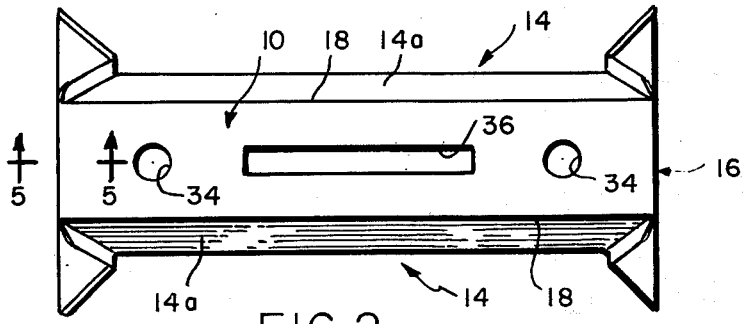
FIG. 2 is a top view of FIG. 1.
Figure 4:
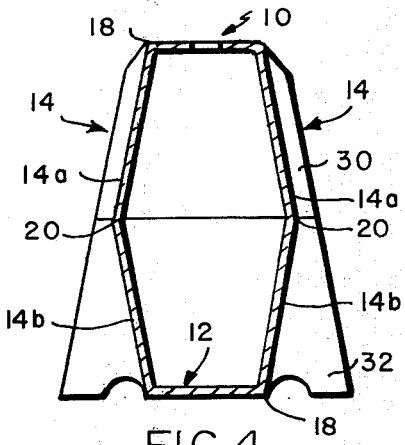
FIG. 4 is a vertical section taken on the line 4—4 of FIG. 2.

The blank as thus constructed is folded on the line X—X to bring the sections 34—34 into face-to-face relation whereupon the tab 44 is folded on the line Y—Y over the edge of the facing section and glued thereto. In the folded position of the sections 38—38 the sections 40 and 42 will be superimposed and the end tabs 46 are then folded on the line Z—Z and glued to the end of the sections 40—40. The resulting structure is that shown in FIG. 8 and to erect it to form the structures shown in FIGS. 1 to 3 pressure is applied to the opposite ends in the direction of the arrows, FIG. 8, to push the ends toward each other which automatically raises the structure so that the end walls are pressed into the recessed open ends of the expanded structure. They will remain inwardly biased and support the structure fully distended.

It should be understood that the present disclosure is for the purpose of illustration only and includes all modifications or improvements which fall within the scope of the appended claims.

I claim:

1. A pencil caddy, comprising an elongated hollow body having top, bottom and side walls, said side walls being hinged at their upper and lower edges to the top and bottom walls, and hinged intermediate their top and bottom edges parallel to the hinges at the top and bottom edges, said body having open ends the edges of which are defined by the end edges of the top, bottom and side walls and said edges of the side walls at each end sloping from the edges of the top and bottom walls inwardly and meeting at the hinge line intermediate the side walls, such that the end openings are re-entrant and end members hinged at the opposite ends to the end edges of the top and bottom walls and corresponding in length to the lengths of the end edges of the side wall, said end members being adapted to be sprung into the re-entrant openings to hold the body distended and to be withdrawn from the openings to permit the body to be flattened.

2. A structure according to claim 1, comprising parts extending laterally from the end members and in the plane thereof and symmetrically with respect to the axis of the body, comprising laterally spaced supports for supporting the body in stable equilibrium.

3. A structure according to claim 1, wherein the body has in the top wall openings for receiving articles for upright support therein.

4. A pencil caddy, comprising an elongated hollow body having four quadrilaterally arranged side walls hinged longitudinally to each other and two of the opposed side walls being hinged intermediate their edges parallel to the hinges connecting the side walls, so as to be flattened in a plane containing said intermediate hinges, said body having open ends defined by the end edges of the four side walls, the end edges of the side walls hinged intermediate their edges sloping inwardly toward the intermediate hinges so that the end openings are re-entrant and flexible end members hinged at their opposite ends to the end edges of the other two side walls and corresponding in length to the length of the end edges of the side walls intermediate their ends, said end members being adapted when pressed into the recessed openings to hold the body distended and when withdrawn to permit the body to collapse.

5. A structure according to claim 4, wherein one of the side walls contains openings to the interior of the body for receiving and supporting an article therein.

6. A structure according to claim 4, wherein one end at least of each end member has laterally spaced feet in the plane of the end member for supporting the body in stable equilibrium.

* * * * *